US007508367B2

(12) United States Patent
O'Donnell

(10) Patent No.: US 7,508,367 B2
(45) Date of Patent: Mar. 24, 2009

(54) DRIVE CIRCUIT FOR IMPROVED BRIGHTNESS CONTROL IN LIQUID CRYSTAL DISPLAYS AND METHOD THEREFOR

(75) Inventor: Eugene Murphy O'Donnell, Fishers, IN (US)

(73) Assignee: Thomson Licensing, Boulogne-Billancourt (FR)

( * ) Notice: Subject to any disclaimer, the term of this patent is extended or adjusted under 35 U.S.C. 154(b) by 292 days.

(21) Appl. No.: 10/182,479

(22) PCT Filed: Nov. 29, 2001

(86) PCT No.: PCT/US01/44745

§ 371 (c)(1),
(2), (4) Date: Jul. 30, 2002

(87) PCT Pub. No.: WO02/45065

PCT Pub. Date: Jun. 6, 2002

(65) Prior Publication Data

US 2003/0001811 A1 Jan. 2, 2003

Related U.S. Application Data

(60) Provisional application No. 60/250,196, filed on Nov. 30, 2000.

(51) Int. Cl.
*G09G 3/36* (2006.01)

(52) U.S. Cl. ..... 345/90; 345/92

(58) Field of Classification Search ..... 345/87–103, 345/211, 212, 90, 96

See application file for complete search history.

(56) References Cited

U.S. PATENT DOCUMENTS 5,250,937 A 10/1993 Kikuo et al. ..... 345/89
5,526,014 A 6/1996 Shiba
5,627,557 A * 5/1997 Yamaguchi et al. ..... 345/90
5,952,991 A * 9/1999 Akiyama ..... 345/98
6,034,675 A 3/2000 Yamazaki ..... 345/211

(Continued)

FOREIGN PATENT DOCUMENTS

EP 0 541 364 A1 5/1993

(Continued)

OTHER PUBLICATIONS

EP Supplementary Partial Search Report dated May 15, 2007.

(Continued)

*Primary Examiner*—Jimmy H Nguyen
(74) *Attorney, Agent, or Firm*—Robert D. Shedd

(57) ABSTRACT

A display driver for a display unit having a memory element and a liquid crystal cell includes a first display driver circuit having a first storage capacitor and a first differential amplifier coupled between the first storage capacitor and the liquid crystal cell and a second display driver circuit having a second storage capacitor (14') an a second differential amplifier (16') coupled between the second storage capacitor and the liquid crystal cell. The display driver also includes a first switching mechanism enabling the switching of the display driver between the first display driver circuit during a positive frame and a second display driver circuit during a negative frame and a second switching mechanism coupled to a supply voltage. The second switching mechanism is controlled by at least one global address line.

12 Claims, 5 Drawing Sheets

U.S. PATENT DOCUMENTS

| | | | | |
|---|---|---|---|---|
| 6,064,362 | A * | 5/2000 | Brownlow et al. | 345/98 |
| 6,069,605 | A | 5/2000 | Ozawa | |
| 6,181,311 | B1 | 1/2001 | Hashimoto | |
| 6,278,426 | B1 * | 8/2001 | Akiyama | 345/87 |
| 6,331,844 | B1 * | 12/2001 | Okumura et al. | 345/87 |
| 6,414,664 | B1 * | 7/2002 | Conover et al. | 345/89 |

FOREIGN PATENT DOCUMENTS

| | | | |
|---|---|---|---|
| EP | 0 755 044 | A1 | 1/1997 |
| JP | 09288261 | A | 11/1997 |
| WO | WO 95/01701 | A | 1/1995 |

OTHER PUBLICATIONS

Supplemental European Search Report dated Oct. 8, 2008.

* cited by examiner

DRIVE CIRCUIT FOR IMPROVED BRIGHTNESS CONTROL IN LIQUID CRYSTAL DISPLAYS AND METHOD THEREFOR

This application claims the benefit under 35 U.S.C. § 365 of International Application PCT/US01/44745, filed Nov. 29, 2001, which claims the benefit of U.S. Provisional Application 60/250,196, filed Nov. 30, 2000.

BACKGROUND OF THE INVENTION

1. Field of the Invention

This invention relates to the field of video systems utilizing a liquid crystal display (LCD) or liquid crystal on silicon (LCOS), and in particular, to a driver circuit for improving brightness control in LCOS/LCD projection systems.

2. Description of Related Art

Liquid crystal on silicon (LCOS) can be thought of as one large liquid crystal formed on a silicon wafer. The silicon wafer is divided into an incremental array of tiny plate electrodes. A tiny incremental region of the liquid crystal is influenced by the electric field generated by each tiny plate and the common plate. Each such tiny plate and corresponding liquid crystal region are together referred to as a cell of the imager. Each cell corresponds to an individually controllable pixel. A common plate electrode is disposed on the other side of the liquid crystal. The drive voltages are supplied to plate electrodes on each side of the LCOS array. Each cell, or pixel, remains lighted with the same intensity until the input signal is changed, thus acting as a sample and hold (so long as the voltage is maintained, the pixel brightness does not decay). Each set of common and variable plate electrodes forms an imager. One imager is typically provided for each color, in this case, one imager each for red, green and blue.

It is typical to drive the imager of an LCOS display with a frame-doubled signal to avoid 30 Hz flicker, by sending first a normal frame in which the voltage at the electrodes associated with each cell is positive with respect to the voltage at the common electrode (positive picture) and then an inverted frame in which the voltage at the electrodes associated with each cell is negative with respect to the voltage at the common electrode (negative picture) in response to a given input picture. The generation of positive and negative pictures ensures that each pixel will be written with a positive electric field followed by a negative electric field. The resulting drive field has a zero DC component, which is necessary to avoid image sticking, and ultimately, permanent degradation of the imager. It has been determined that the human eye responds to the average value of the brightness of the pixels produced by these positive and negative pictures so long as the frame rate is above 120 Hertz.

The present state of the art in LCOS requires the adjustment of the common-mode electrode voltage, denoted VITO, to be precisely between the positive and negative field drive for the LCOS. The subscript ITO refers to the material indium tin oxide. The average balance is necessary in order to minimize flicker, as well as to prevent a phenomenon known as image sticking.

In the current art, the LCOS drive cell looks much like a conventional Active Matrix LCD driver. This does not work well, due to the various artifacts discussed in the literature. The main causes are parasitic capacitance cross-talk, residual voltage in the LC cell, and voltage droop of the LC, due to ionic leakage and bulk resistivity of the LC material. Mainly, this has been solved by: 1. Increasing the cell capacitance (limited by physical area), 2. Changing to higher resistivity LC materials (limits flexibility and response time), 3. Increasing the frame scan rate to more than 60 Hz (expensive, and costs more bandwidth), 4. Strongly controlling the temperature of the device, to maintain high voltage holding ratio (VHR). All these detriments also have an impact on the ability to control brightness in a liquid crystal or LCOS display.

The prior method for implementing brightness control in a display consists of performing a mathematical add function on the digital data prior to applying it to the display. The problem with this method is that depth of color is greatly impacted, since all of the brightness range must be accommodated in the pre-processing. Moreover, there is no way to blank the display without destroying the data in the typical architecture.

BRIEF SUMMARY OF THE INVENTION

In a first aspect of the present invention, a display unit having an array of liquid crystal cells, comprises an array of display drivers, where a given display driver being associated with a given liquid crystal cell comprises a driver circuit including a memory cell for the given liquid crystal cell and a switching arrangement coupled to the driver circuit and to at least a supply voltage source, where the switching arrangement globally controls the supply voltage to the array of display drivers and when the voltage from the memory cell for the given liquid crystal cell gets applied to the liquid crystal cell.

In a second aspect of the present invention, a display driver for a display unit having a memory element and a liquid crystal cell comprises a first display driver circuit having a first storage capacitance and a first amplifier coupled between the first storage capacitance and the liquid crystal cell and a second display driver circuit having a second storage capacitance an a second amplifier coupled between the second storage capacitance and the liquid crystal cell. The display driving also preferably comprises a first switching arrangement enabling the switching of the display driver between the first display driver circuit during a positive frame and a second display driver circuit during a negative frame and a second switching arrangement coupled to at least a supply voltage, wherein the second switching mechanism is controlled by at least one global address line.

In a third aspect of the present invention, a display driver for a display unit which includes a plurality of display elements arranged in a matrix of rows and columns and a memory element and a liquid crystal cell comprises a driver for switchably outputting one of a plurality of voltages to the display elements on at least one of the matrix of rows and columns, said driver including a decoder and a plurality of analog switches, each analog switch being controlled by the decoder. The display driver further comprises a first switching mechanism enabling the switching of the display driver between a first display driver circuit during a positive frame and a second display driver circuit during a negative frame and a second switching mechanism coupled to at least a supply voltage, wherein the second switching mechanism is controlled by at least one global address line.

In a fourth aspect of the present invention, a method for driving a liquid crystal on silicon display having a plurality of driver circuits for a liquid crystal cell comprises the steps of switching between the plurality of driver circuits using a first switching mechanism comprising a first pair of transistors and controlling a blanking function using a second switching mechanism comprising a second pair of transistors coupled to at least a supply voltage and wherein the second switching mechanism is controlled by at least one global address line.

In a fifth aspect of the present invention, a method for driving a display having a plurality of driver circuits comprises the steps of providing isolation between a storage capacitor and a liquid crystal cell using a differential amplifier in each of the plurality of driver circuits and switching between the plurality of driver circuits for the liquid crystal cell using a first switching mechanism. The method of driving a display further comprises the step of controlling functions using a second switching mechanism, wherein the functions are selected among the group of functions comprising brightness control, dynamic range control for a digital to analog converter, or a global fast blanking of the display.

DETAILED DESCRIPTION

Figure 1:
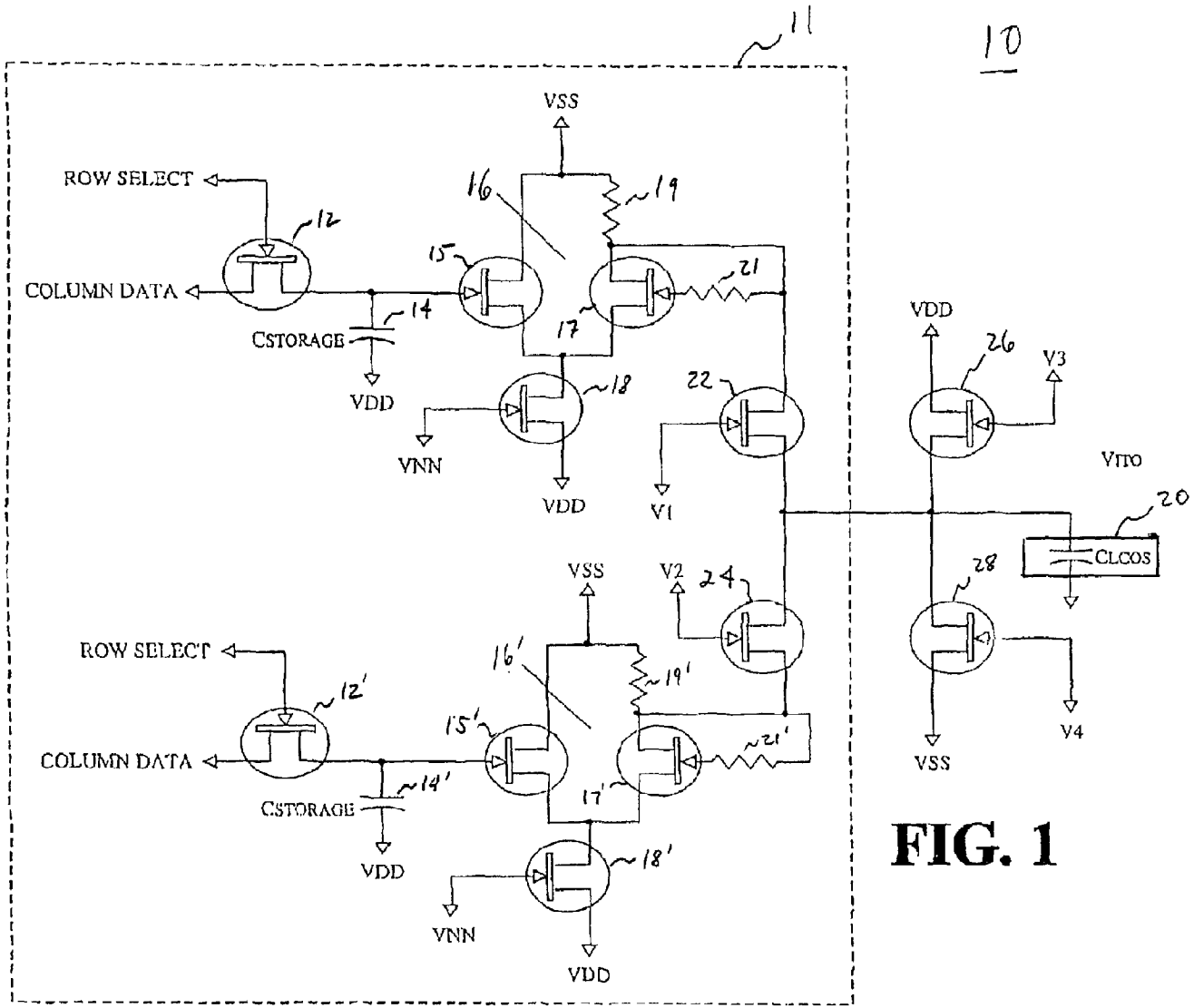
FIG. 1 is a block diagram of a liquid crystal cell driver in accordance with the present invention.

In accordance with the inventive arrangements, two globally controlled transistors (26 and 28) are added to form the driver cell or circuit 10. By doing this, it is possible to apply a forced black or white state to all of the LCOS or liquid crystal (LC) cells by controlling the on time via the globally controlled transistors 26 and 28. When either transistor 26 or 28 are conductive, then transistors 22 and 24 must be non-conductive. These additional devices (26 and 28) can perform various functions. First, they can apply a fixed global amount of RMS voltage or offset to the LC. This offset is equivalent to a brightness function. Second, by controlling the on time of the upper transistor 26 or lower transistor 28, it is possible to make the entire display white, or black, without having to overwrite the data stored in the storage cells (14 or 14') resulting in the effect of global fast blanking of the display. The usage of the brightness offset to level shift the RMS voltage from the data cells upward into the useful active region increases the dynamic range of the digital to analog converter (DAC) (not shown) that provides column data containing video information to corresponding storage cells 14 and 14'.

Figure 2:
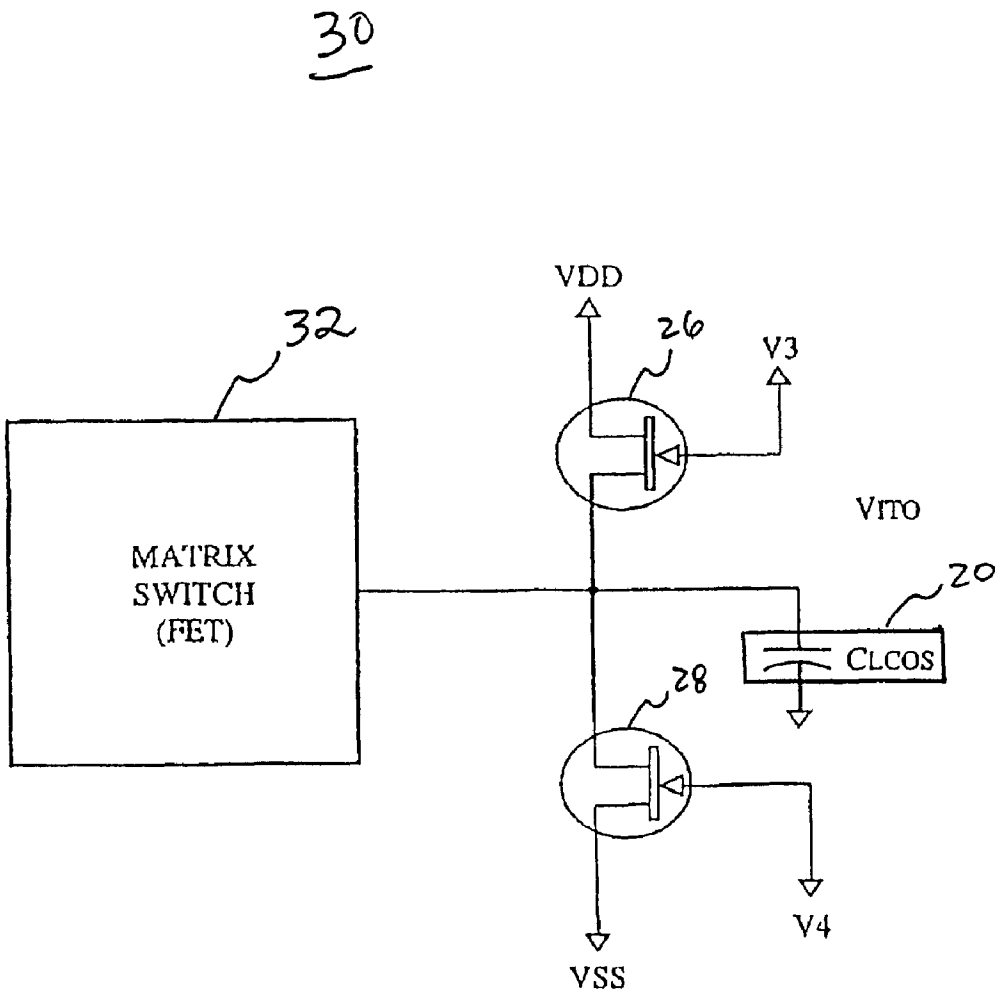
FIG. 2 is a block diagram of another liquid crystal cell driver in accordance with the present invention.

Referring to FIG. 1, the circuit 10 improves the range of brightness control systems in LCOS and LCD displays and further incorporates a driver circuit 11. FIG. 2 illustrates a circuit 30 in conjunction with a known driver circuit 32 in the form of a matrix switch (FET).

With reference to FIG. 1, the driver circuit 11 is shown in the dashed block. The basic advantage of circuit 11 and method for driving LCOS or LC displays is that it uses two separate storage elements (14 and 14') and drive circuits that are switched to drive the LC cell. This allows for a fast switching frequency, which makes the flicker rate of the LC cell much above frequencies detectable by the human eye. It also allows for the possibility of switching the common electrode voltage (VITO) to help to increase the possible RMS voltage on the LC cell for a given operating voltage of the silicon back plane.

The upper cell driver that includes transistor 22 contains the voltage to drive the LC during the "positive" frame, the lower cell driver that includes transistor 24 contains the voltage to drive the LC in the "negative" frame. These must be balanced with VITO in order to avoid a net DC voltage on the LC cell, and resultant imager retention and reliability issues. VDD and VSS are the upper and lower operating voltages for the CMOS devices. VNN is set to regulate the current through the transistors 15 and 17, and controls the power dissipation of the amplifier (16 or 16'). V1 and V2 are global switching voltages that determine which amplifier (16 or 16') is driving the liquid crystal cell.

The inventive arrangements use a global switch preferably using two transistors (26 and 28), shown to the right of the dashed block, to apply a fixed RMS voltage to the LC cell which is identical or in common for all of the LC cells in the display. The effect of this global switch is to provide three new and advantageous features for the device. The first advantage is an improvement in contouring, because the unusable portion of the typical transfer function can be excluded without using analog DAC range. This improvement can be achieved by manipulating the amount of time that V3 and V4 are on to force the LC to be driven to a certain brightness level near a full brightness level or to bring up a darkness level as examples. The second advantage is a net luminance offset voltage, which can emulate a brightness control, again without consuming dynamic range in the DACs. The third advantage is a mechanism for making the entire display either black or white, without changing the underlying video data. This applies to analog drives for both LCD and LCOS displays.

In circuit 11 shown in the dashed block, the differential amplifiers 16 and 16' respectively advantageously decouple the LC cell from the memory element (14 or 14'). In conjunction with that idea, the inventive arrangements add a pair of additional transistors 26 and 28 connected to VDD and VSS respectively, and which are respectively controlled by two global addressing lines V3 and V4. These two additional control switches in the form of transistors 26 and 28 allow for implementing a brightness control, improving dynamic range of the drive DAC, and blanking of the display (either white or black). The brightness function can be implemented independently of the isolation amplifiers, but the other functions of improved dynamic range and blanking need the isolation provided by the differential amplifiers.

The voltages V3 and V4 control the time for which VDD and VSS are applied to the LC cell. The voltage V1 controls the time for when the voltage at the memory cell or storage capacitance 14 is applied to the liquid crystal 20 and the voltage V2 controls the time for when the voltage at the memory cell or storage capacitance 14' is applied to the liquid crystal 20. Only one of the voltages V1 through V4 should be active at any given time.

In a system where Vito is fixed, the present invention limits the maximum and minimum RMS voltage being applied to the LC by limiting the amount of time that Vdd, Vss, and the voltage in the respective storage capacitors are applied. Thus, with respect to FIG. 1, the effective voltage applied to the LC is the product of 4 time intervals and 4 voltages. If $Tv_1$, $Tv_2$, $Tv_3$, and $Tv_4$ are the respective time intervals when the respective transistors 22, 24, 26, and 28 are switched on, and $V_{14}$ and $V_{14'}$ are the respective voltages in storage capacitor 14 and storage capacitor 14', then the effective voltage on the LC could be computed as follows:

$$Tv_3\times(Vdd-Vito)+$$
$$Tv_1\times(V_{14}-Vito)+$$
$$Tv_4\times(Vss-Vito)+$$
$$Tv_2\times(V_{14'}-Vito)$$

wherein the RMS voltage is determined by dividing the result above by ($Tv_1+Tv_2+Tv_3+Tv_4$).

The inventive arrangements can also be used in conjunction with a prior art matrix switch (FET) driver circuit 32 as shown in the circuit 30 of FIG. 2.

The inventive arrangements taught herein can be used with a control system wherein VITO is held constant or wherein VITO varies.

As shown in FIG. 1, a differential amplifier 16 is preferably added between the internal storage capacitor or memory element 14 and the LC cell 20 in order to overcome some of the problems described above. In other words, a drive amplifier is added to the driving cell. This adds isolation between the storage capacitor and the LC cell. The added current drive capability ensures that the voltage on the pixel will rapidly become that desired. It also allows for very low leakage current from the storage capacitor (FET has very high input impedance), and allows for a continuous refresh of the voltage on the LC, which eliminates the 'droop' problem, as well as the residual voltaic potential stored in the cell. This should improve both the flicker issue, as well as the 'image sticking' problem which is associated with the inability to achieve DC balance in the cell. It should also allow the cell to work well even at somewhat elevated temperatures.

The disadvantage of this technique is that it increases the DC current through the LC cell. This can be overcome in part by gating the current source in the bottom of the differential amplifier. This can use the 'pixel select' bit in the device. In this way, a periodic refresh of the voltage can be achieved, while reducing the power consumption by 1/nrow, where nrow is the number of rows in the device. Since heating is uniform, this gating in some situations may not be needed.

A typical implementation in CMOS of the driver 11 is shown in FIG. 1 and will be explained in further detail. The components are schematic representations, and alternate configurations can be used without loss of generality. Note that the circuit 11 illustrates an upper driver circuit and a lower driver circuit, but each of these driver circuits is preferably substantially the same with comparable components shown for the lower driver circuit with an additional "'" designation. The key points are the buffer amplifier (16 or 16'), which applies a closed loop correction voltage to the LC cell, and the gated current source which allows reduction of power consumption.

Typically amplifier (16 or 16') could be implemented with 3 transistors, which can be placed under the LC cell in an LCOS display device. In the arrangement of FIG. 1, the amplifier 16 decouples the LC cell from the memory element 14. FIG. 1 illustrates a liquid crystal cell driver 10 for a liquid crystal display. The liquid crystal cell driver preferably comprises a plurality of transistors (12, 15, 17, and 18), a storage capacitance such as a storage capacitor 14, and a plurality of resistors 19 and 21 and the liquid crystal cell represented by liquid crystal capacitance 20. Preferably, three (3) transistors, such as transistors 15, 17 and 18 form the amplifier 16, preferably in the form of a differential amplifier. The differential amplifier 16 is preferably comprised of N-Channel transistors having respective sources coupled and the drain of transistor 18 serving as an output to the liquid crystal cell (20). Additionally, the respective sources of the differential amplifier 16 are coupled and driven by a current source which is another N-Channel transistor such as transistor 18 that sets the balance current in the differential amplifier. As previously explained, the differential amplifier 16 is coupled between the storage capacitor 14 and provides isolation between the storage capacitor 14 and a liquid crystal cell 20 or pixel. As shown, the circuit 10 further comprises two globally controlled transistors 26 and 28 which among other functions previously discussed enable a forced black or white state to all of the LCOS or liquid crystal (LC) cells by controlling the on time of the two additional switched transistors (26 and 28).

Referring to FIG. 2, another liquid crystal cell driver 30 is shown similar to the liquid crystal cell driver 10 of FIG. 1. In this instance, the known brightness control circuit 32 in the form of a matrix switch replaces the circuit 11 disclosed with respect to FIG. 1. Once again, as with the liquid crystal cell driver 10, the liquid crystal cell driver 30 also preferably comprises the two globally controlled transistors 26 and 28 and the liquid crystal capacitance 20 as shown.

Figure 3:
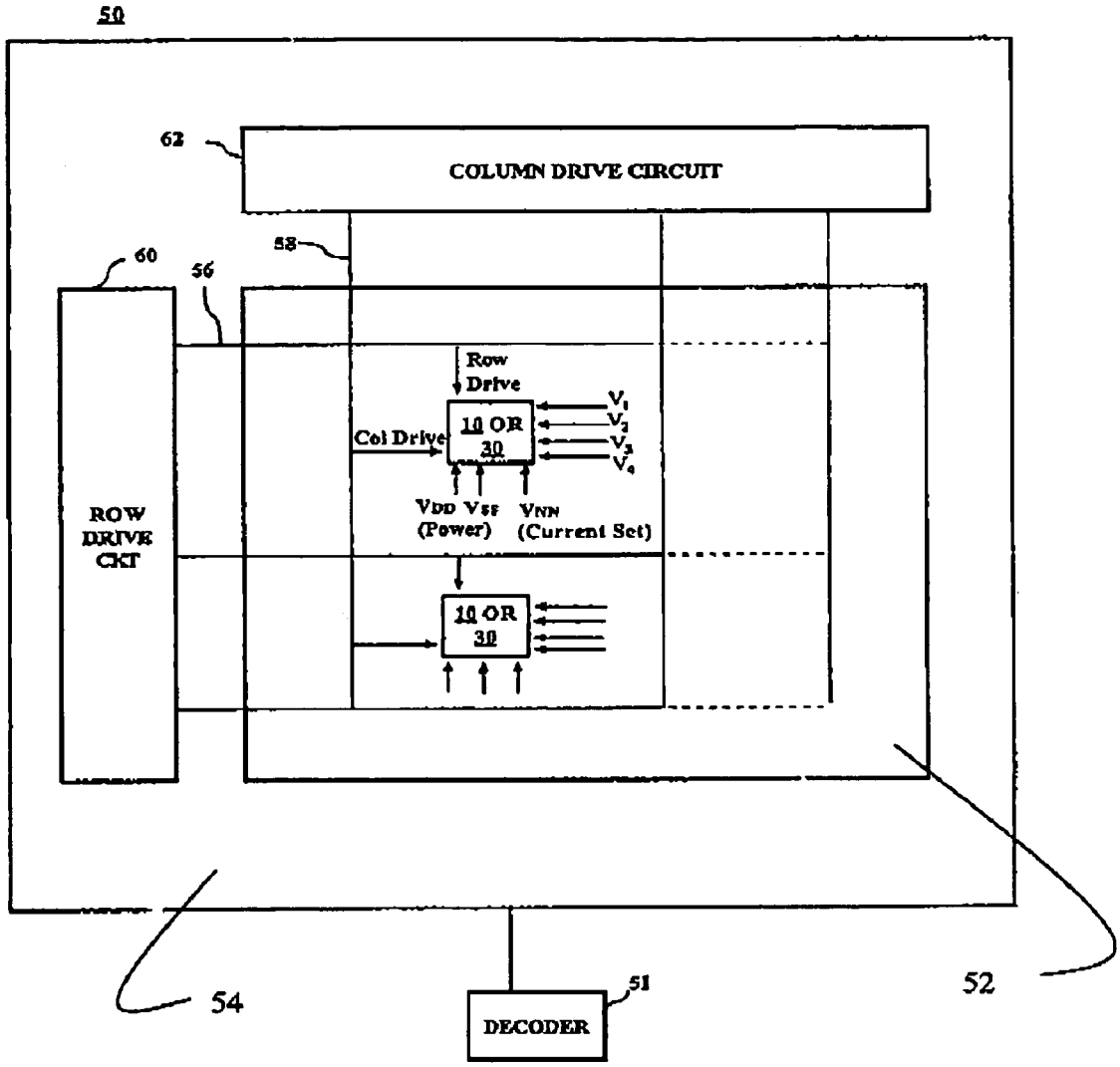
FIG. 3 is a block diagram of a display unit utilizing a liquid crystal cell driver in accordance with the present invention.

Referring to FIG. 3, a display unit 50 is shown that can utilize the display drivers 10 or 30 as previously described above. The display unit 50 preferably includes a plurality of display elements arranged in a matrix of rows and columns and a memory element and a liquid crystal cell. The driver preferably switchably outputs one of a plurality of voltages to the display elements on at least one of the matrix of rows and columns, the display unit including a conventional decoder 51 and the driver controlled by the decoder 51. The driver includes a storage capacitor or memory element 14 coupled between the decoder and the semiconductor switch and a differential amplifier coupled between the storage capacitor and the liquid crystal cell, whereby the differential amplifier provides isolation between the storage capacitor and the liquid crystal cell. This driver can include a decoder and a plurality of switches controlled by an output of the decoder. As shown in FIG. 3, the display unit 50 can include a row drive circuit having a plurality of row (scanning) address lines 56 and a column drive circuit 62 having a plurality of column (data) address lines 58. This matrix of rows and columns are on a substrate 54 and sandwiched between another substrate 52.

Figure 4:
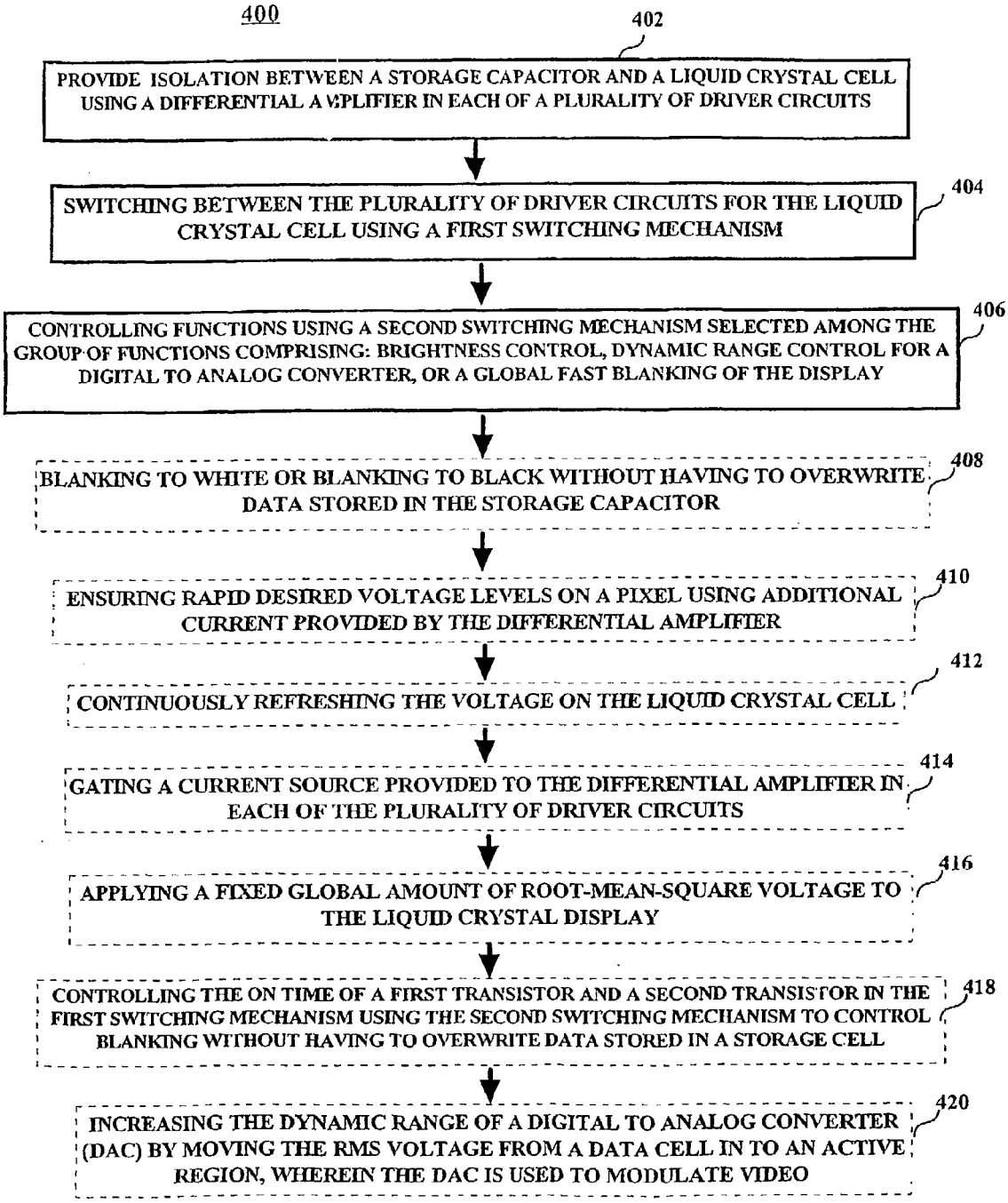
FIG. 4 is a flow chart illustrating a method of driving a display in accordance with the present invention.

Referring to FIG. 4, a flow chart is shown illustrating a method 400 of driving a display in accordance with the present invention where a plurality of driver circuits are used to drive a liquid crystal cell. The method 400 preferably comprises the step 402 of providing isolation between a storage capacitor and a liquid crystal cell using a differential amplifier, the step 404 of switching between the plurality of driver circuits for the LC cell using a first switching mechanism, and the step 406 of controlling functions using a second switching mechanism where the functions are selected among the group of functions comprising brightness control, dynamic range control for a DAC, or a global fast blanking of the display. The method 400 may further comprise the alternative function described in step 408 or blanking to white or blanking to black without having to overwrite data stored in a storage capacitor or a memory cell or the step 410 of ensuring rapid desired voltage levels on a pixel or cell using additional current provided by the differential amplifier. Additionally, the method 400 may alternatively comprise the step 412 of continuously refreshing the voltage on the LC cell or the step 414 of gating a current source provided to the differential amplifier in each of the plurality of driver circuits or the step 416 of applying a fixed global amount of RMS voltage to the LC display. Another alternative function comprises the control of the on time of a first transistor and a second transistor in the first switching mechanism using the second switching mechanism as shown in step 418. This enables the control of blanking without having to overwrite data stored in a storage cell as previously explained. Finally, method 400 may also comprise the alternative or optional step 420 of increasing the dynamic range of a DAC used to modulate video by moving the RMS voltage from a data cell into an active region.

Figure 5:
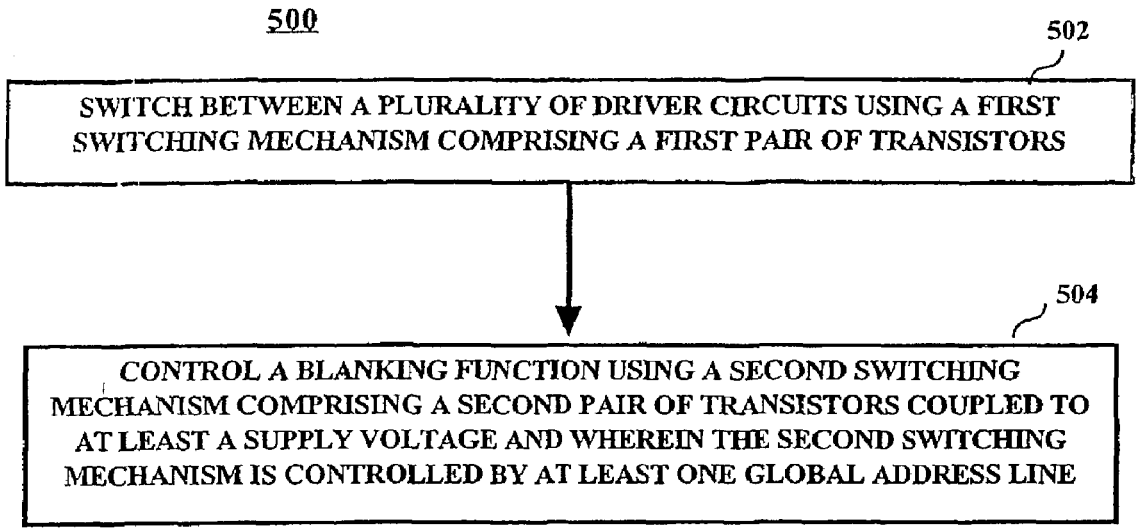
FIG. 5 is a flow chart illustrating another method of driving a display in accordance with the present invention.

Referring to FIG. 5, a flow chart is shown illustrating a alternative method 500 of driving a display in accordance with the present invention. In this instance, the method preferably comprises the step 502 of switching between a plurality of driver circuits using a first switching mechanism comprising a first pair of transistors and the step 504 of controlling a blanking function using a second switching mechanism. The second switching mechanism preferably comprises a second pair of transistors coupled to at least a supply voltage and wherein the second switching mechanism is controlled by at least one global address line.

Although the present invention has been described in conjunction with the embodiments disclosed herein, it should be understood that the foregoing description is intended to illustrate and not limit the scope of the invention as defined by the claims.

The invention claimed is:

1. A display driver for a display unit having a memory element and a liquid crystal cell, comprising:

a first display driver circuit having a first storage capacitor and a first differential amplifier coupled between the first storage capacitor and the liquid crystal cell;

a second display driver circuit having a second storage capacitor and a second differential amplifier coupled between the second storage capacitor and the liquid crystal cell;

a first switching arrangement coupled to the liquid crystal cell and enabling switching the output of the first differential amplifier to the cell during a positive frame and the output of the second differential amplifier to the cell during a negative frame; and a second switching arrangement coupled to the liquid crystal cell and coupled to at least a supply voltage, wherein the second switching arrangement is controlled by at least one global address line that operates to blank the display unit while leaving unaltered data stored in the first storage capacitor and the second storage capacitor; wherein the second switching arrangement comprises a first transistor configured to force the liquid crystal cell to display white during blanking the display unit and a second transistor configured to force the liquid crystal cell to display black during blanking the display unit.

2. The display driver of claim 1, wherein the first and second differential amplifiers provides isolation between the first storage capacitor and the liquid crystal cell and the second storage capacitor and the liquid crystal cell respectively.

3. The display driver of claim 1, wherein the first switching arrangement comprises a first transistor driven by a first global switching voltage and a second transistor driven by a second global switching voltage.

4. The display driver of claim 1, wherein the second transistor of the second switching arrangement is driven by a first global address line and the second transistor of the second switching arrangement is driven by a second global address line.

5. The display driver of claim 1, wherein each of the first and second differential amplifiers comprises a pair of N-Channel transistors having respective sources coupled together and a drain from one of the pair of N-Channel transistors serving as an output to the liquid crystal cell.

6. The display driver of claim 1, wherein each of the first and second differential amplifiers comprises a pair of N-channel transistors having respective sources coupled together and a current source and ensures a predetermined voltage on a pixel.

7. The display driver of claim 1, wherein the display unit comprises a liquid-crystal-on-silicon display.

8. A display unit having an array of liquid crystal cells, comprising:

an array of display drivers, each display driver being associated with a corresponding liquid crystal cell and each display driver including:

a driver circuit for the corresponding liquid crystal cell, wherein the driver circuit includes a memory cell; and a switching arrangement coupled to the liquid crystal cell and to at least a supply voltage source, wherein the switching arrangement globally controls a voltage developed in the corresponding liquid crystal cell via a signal path that bypasses the driver circuit for the corresponding liquid crystal cell, the switching arrangement operates to blank the display unit while leaving unaltered data stored in the memory cell; wherein the switching arrangement comprises a first transistor configured to force the liquid crystal cell to display white during blanking of the display unit and a second transistor configured to force the liquid crystal cell to display black during blanking of the display unit.

9. The display unit of claim 8, wherein the array of display drivers comprises a matrix switch driver.

10. The display unit of claim 8, wherein the driver circuit comprises a first display driver circuit having a first storage capacitor and a first differential amplifier coupled between the first storage capacitor and the liquid crystal cell, a second display driver circuit having a second storage capacitor and a second differential amplifier coupled between the second storage capacitor and the liquid crystal cell, and a first switching arrangement enabling the switching of the display driver between the first display driver circuit during a positive frame and the second display driver circuit during a positive frame and a second display driver circuit during a negative frame.

11. The display unit of claim 10, wherein the first switching arrangement comprises a first transistor controlled by a first global address line that determines when a supply voltage Vdd is applied to the liquid crystal cell and a second transistor controlled by a second global address line that determines when a supply voltage Vss is applied to the liquid crystal cell.

12. The display unit of claim 8, wherein the array of liquid crystal cells comprises a liquid-crystal-on-silicon display.

* * * * *